United States Patent [19]

Hiraga

[11] Patent Number: 4,466,784

[45] Date of Patent: Aug. 21, 1984

[54] DRIVE MECHANISM FOR A SCROLL TYPE FLUID DISPLACEMENT APPARATUS

[75] Inventor: Masaharu Hiraga, Honjo, Japan

[73] Assignee: Sanden Corporation, Gunma, Japan

[21] Appl. No.: 354,512

[22] Filed: Mar. 3, 1982

[30] Foreign Application Priority Data

Mar. 3, 1981 [JP] Japan ..... 56-29433

[51] Int. Cl.[3] ..... F01C 1/02; F01C 17/06; F01C 19/12; F01C 21/02

[52] U.S. Cl. ..... 418/55; 418/104; 418/151; 308/179

[58] Field of Search ..... 418/55, 104, 151, 59; 417/410; 308/179

[56] References Cited

U.S. PATENT DOCUMENTS

| | | | |
|---|---|---|---|
| 1,098,458 | 6/1914 | Nelson | 418/59 |
| 1,156,700 | 10/1915 | May | 418/59 |
| 3,463,091 | 8/1969 | Delsuc | 418/57 |
| 3,994,636 | 11/1976 | McCullough et al. | 418/55 |
| 4,082,484 | 4/1978 | McCullough | 418/55 |
| 4,201,521 | 5/1980 | Carlson | 417/410 |

*Primary Examiner*—John J. Vrablik

*Attorney, Agent, or Firm*—Banner, Birch, McKie & Beckett

[57] ABSTRACT

A scroll type fluid displacement apparatus is disclosed. The apparatus includes a housing having a front end plate and a scroll housing. A fixed wrap extends into an operative interior area of the housing from an inner end surface of an end plate portion of the scroll housing. An orbiting scroll member has an end plate from which an orbiting wrap extends, and a tubular member axially projecting from the end surface of end plate into the operative interior area of the housing. The tubular member has a hollow interior. A drive shaft is rotatably supported by the front end plate and a crank pin extends from its inner end surface. The crank pin is rotatably carried within the hollow interior of the tubular member through a bearing assembly to thereby rotatably support the orbiting scroll.

17 Claims, 3 Drawing Figures

DRIVE MECHANISM FOR A SCROLL TYPE FLUID DISPLACEMENT APPARATUS

BACKGROUND OF THE INVENTION

This invention relates to a fluid displacement apparatus, and more particularly, to a drive mechanism a scroll type fluid displacement apparatus.

Scroll type fluid displacement apparatus are well known in the prior art. For example, U.S. Pat. No. 801,182 (Creux) discloses a device including two scrolls each having a circular end plate and a spiroidal or involute spiral element. These scrolls are maintained angularly and radially offset so that both spiral elements interfit to make a plurality of line contacts between their spiral curved surfaces to thereby seal off and define at least one pair of fluid pockets. The relative orbital motion of two scrolls shifts the line contacts along the sprial curved surfaces and, as a result, the volume of the fluid pockets change. Since the volume of the fluid pockets increases or decreases dependent on the direction of the orbital motion, the scroll type fluid apparatus is applicable to compress, expand or pump fluids.

Scroll type displacement apparatus can be used as refrigeration compressors in refrigerators or air conditioning apparatus. Such compressors need high efficiency and a high compression ratio, such as a 5 to 10 compression ratio. Therefore, re-expansion volume, i.e., the smallest volume of the fluid pockets in a compression cycle, which in a scroll type compressor is located at the center of the scroll members, must be reduced as much as possible. The inner end portions of the spiral elements are thus extended inwardly to the center of the scroll members as far as possible.

Since the driving mechanism in such a high compression ratio scroll type compressor is connected to the end plate on a side surface opposite from which the spiral element extends, and the reaction force caused by the compression of gas acts at an intermediate location along the height of spiral elements of the orbiting scroll, the point at which the reaction force acts on the orbiting scroll is spaced from the point at whichthe driving force acts on the scroll. If the distance between these points is made relatively long, a moment is created which adversely effects the stability of orbital motion of the orbiting scroll.

However, when a scroll type fluid displacement apparatus requires a ratio of only 1.0 to 1.5, the re-expansion volume need not be reduced as much as in the high compression ratio application, and 1.5 to 2.0 revolutions of the spiral element is generally sufficient. A relatively large space can therefore remain unoccupied in the center of the orbiting scroll.

SUMMARY OF THE INVENTION

It is a primary object of this invention to provide an improvement in a scroll type fluid displacement apparatus, in particular in a lower compression ratio apparatus, wherein dynamic balance is maintained so that the orbiting scroll is driven in a stable condition.

It is another object of this invention to provide a scroll type fluid displacement apparatus which is simple in construction and can be simply and reliably manufactured.

A scroll type fluid displacement apparatus according to this invention includes a housing having a fluid inlet port and a fluid outlet port. A fixed scroll member is joined with the housing and has a first end plate from which a first wrap extends into an operative interior area of the housing. An orbiting scroll has a second end plate from which a second wrap extends. The first and second wraps interfit at an angular and radial offset to make a plurality of line contacts to define at least one pair of fluid pockets.

The orbiting scroll has a tubular member projecting axially from a generally radial central area of its end plate. The tubular member extends into the operative interior area of the housing. In a preferred embodiment, the tubular member extends to at least approximately the axial center of the first wrap but not beyond the axial end thereof. The tubular member has a hollow interior formed through its center. This hollow interior extends between the distal end of the tubular member and the side surface of the end plate opposite to the side thereof from which first wrap extends. A drive shaft is rotatably supported by the housing and has a crank pin extending from its inner end. The crank pin is rotatably carried within the hollow interior of the tubular member to rotatably support the orbiting scroll.

Further objects, features and aspects of this invention will be understood from the following detailed description of a preferred embodiment of this invention, referring to the annexed drawings.

DETAILED DESCRIPTION OF THE INVENTION

Figure 1:
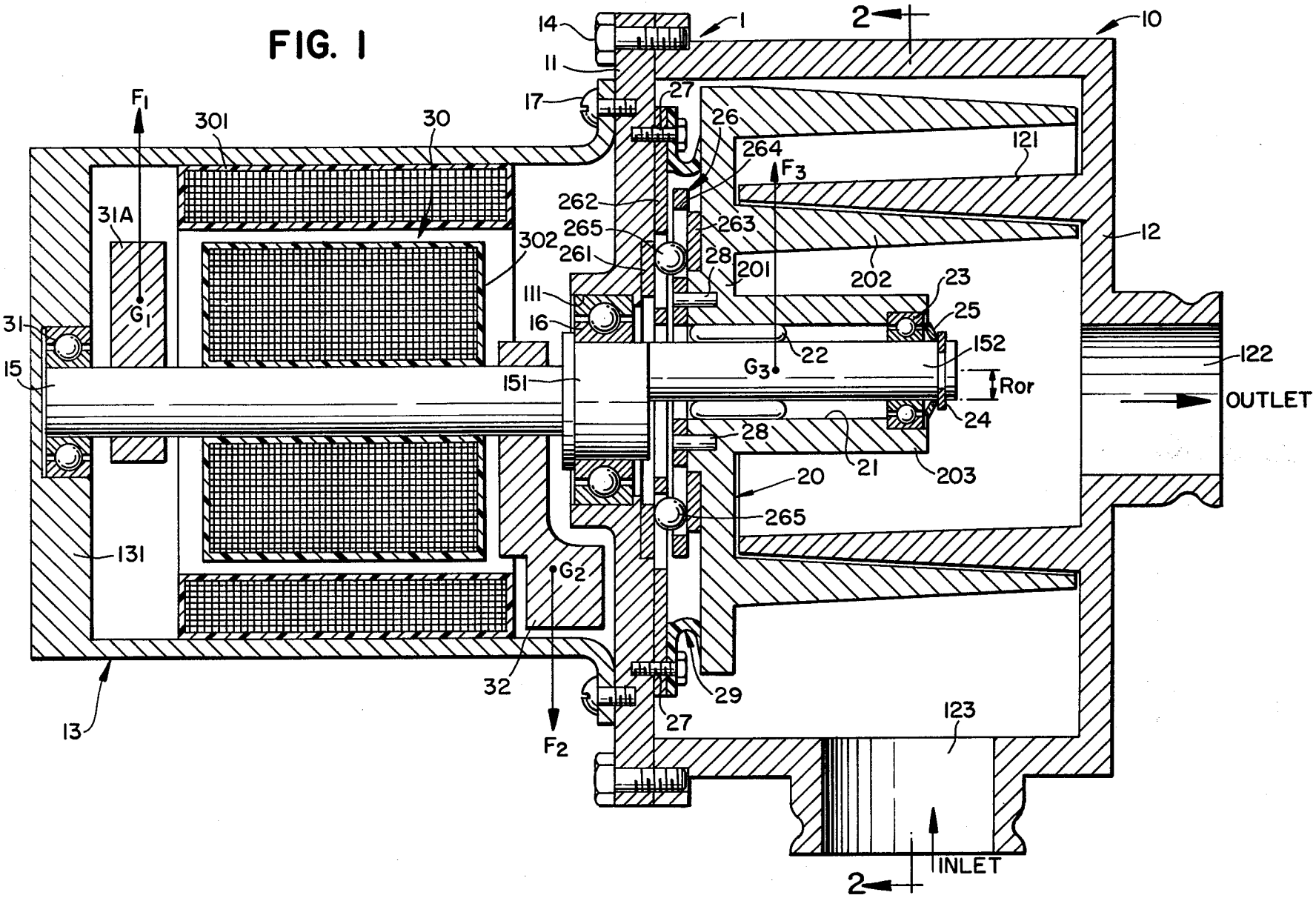
FIG. 1 is a vertical sectional view of a scroll type fluid displacement apparatus according to an embodiment of this invention.
Figure 2:
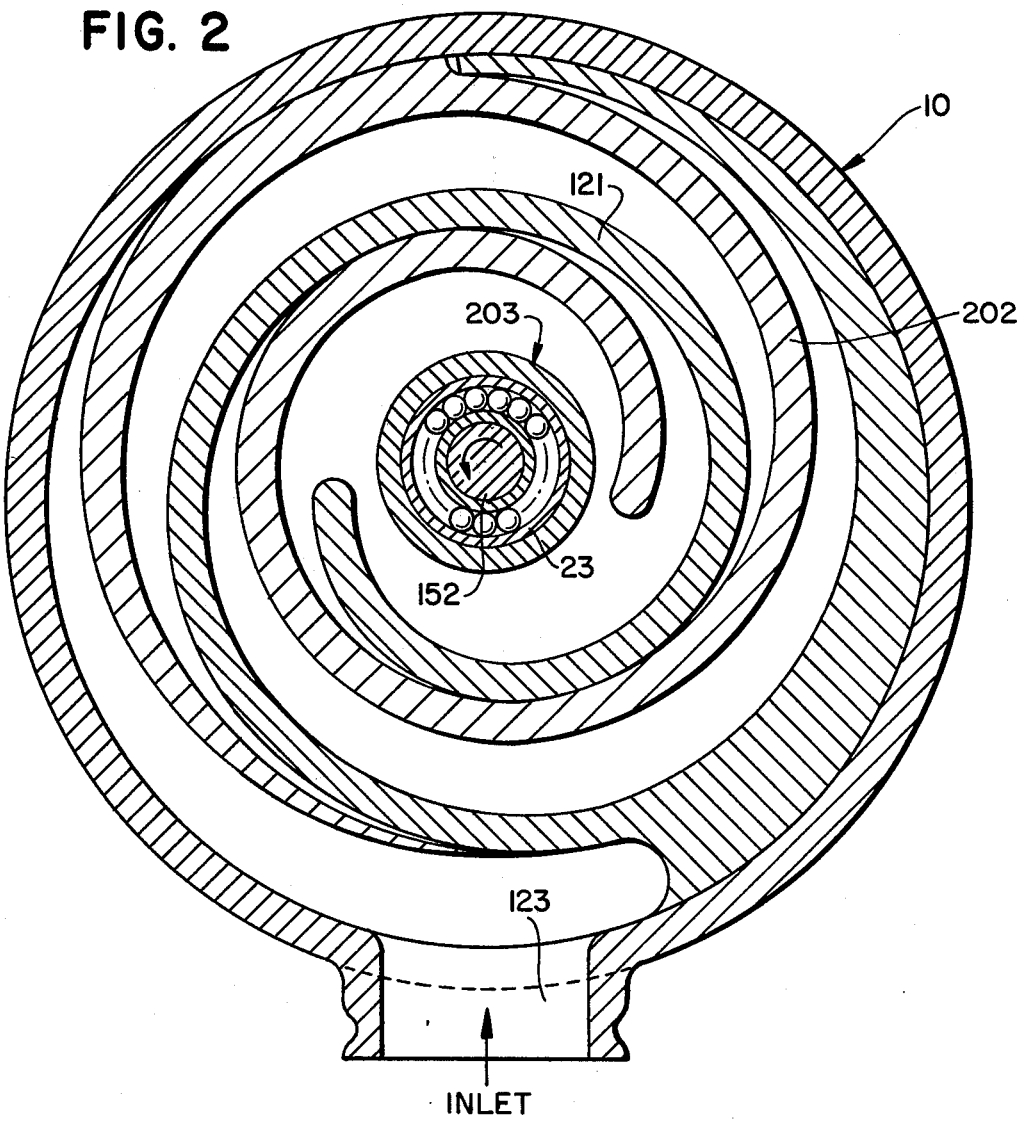
FIG. 2 is a sectonal view taken generally along line II—II in FIG. 1.
Figure 3:
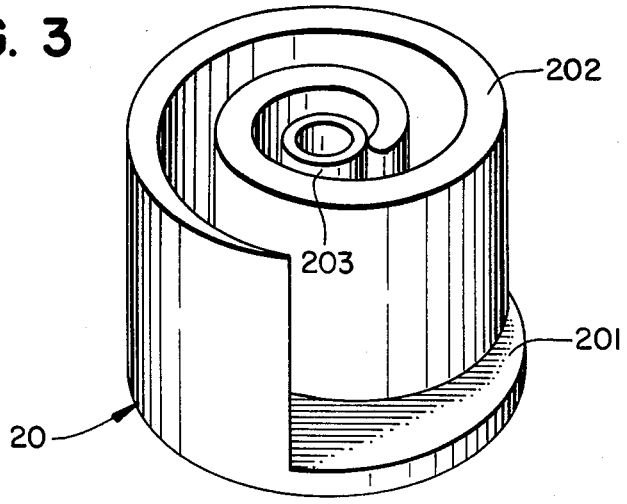
FIG. 3 is a perspective view of the orbiting scroll illustrated in FIG. 1.

Referring to FIG. 1, an embodiment of a fluid displacement apparatus in accordance with the present invention, in particular, a scroll type fluid displacement apparatus 1 is shown. The apparatus 1 includes a housing 10 having a front end plate 11, a scroll housing 12 which is attached to one end surface of front end plate 11, and a motor housing 13 which is attached to the other end surface of front end plate 11.

A spiral element 121 is formed integral with an end plate portion of scroll housing 12 and extends into the interior of scroll housing 12. Spiral element 121 has approximately 1¾turns or revolutions. Spiral element 121 and the end plate portion of scroll housing from which it extends form a fixed scroll of the scroll type fluid displacement apparatus 1. An outlet port 122 is formed through the end plate portion of scroll housing 12 and an inlet port 123 is formed through the outer peripheral surface of scroll housing 12.

An orbiting scroll 20 is also located within scroll housing 12 and includes a circular end plate 201, a wrap or spiral element 202 affixed to or extending from one side surface of circular end plate 201. A tubular member 203 projects axially from a generally central radial area of the side surface of end plate 201. Tubular member 203 extends axially a distance into the operative interior of scroll housing 12, and preferrably to approximately the axial central area of spiral element 202, however, not beyond the axial end of spiral element 202. The central area of end plate 201 is generally at the same location as the involute generating circle of spiral element 202. Spiral element 202 and spiral element 121 interfit at angular offset of 180° and a predetermined radial offset. At least a pair of fluid pockets are thereby defined between spiral elements 121 and 202. Tubular member 203 has a hollow interior 21 extending through its center. Hollow interior 21 thus extends between the distal end of tubular member 203 at the axial central area of spiral elements 121 and 202 and the side surface of end plate 201 opposite to the side thereof from which spiral element 202 extends.

Front end plate 11 is attached to an end surface of scroll housing 12 by a plurality of bolts 14. An opening portion of scroll housing 12 is thus covered by front end plate 11. An inner chamber of scroll housing 12 is sealed off by front end plate 11 and the end plate portion of scroll housing 12. An opening 111 is formed in the center of front end plate 11 for penetration or passage of a drive shaft 15.

Drive shaft 15 has a disk 151 at its inner end which is rotatably supported by front end plate 11 through a bearing 16 located within opening 111 of front end plate 11. A crank or drive pin 152 projects axially from an axial end surface of disk 151 at a position which is radially offset from the center of drive shaft 15. Drive pin 152 is carried in hollow interior 21 of tubular member 203 by bearings 22 and 23. Drive pin 152 has an axial length which extends from its connection point with disc 151, through hollow interior 21, out of tubular member 203 and into the axial central area of the spiral elements 121 and 202. Bearing 22 is located adjacent end plate 201 and bearing 23 is located adjacent the distal end of tubular member 203. Bearings 22, 23 are thus axially spaced from one another. Orbiting scroll 20 is thus rotatably supported at axially spaced locations by crank pin 152 through bearings 22, 23. Bearing 23 is held within a ledge in hollow interior 21 by a snap ring 24 and a spring washer 25. The snap ring 24 is attached on the inner end of crank pin 152 and the spring washer 25 is placed between snap ring 24 and bearing 23. Orbiting scroll member 20 is thus pushed against front end plate 11 by spring washer 25.

A rotation preventing/thrust bearing 26 is located between the inner end surface of front end plate 11 and an end surface of end plate 201 of orbiting scroll 20. Rotation preventing/thrust bearing device 26 includes a fixed race 261 attached to the inner end surface of front end plate 11, a fixed ring 262 attached to the inner end surface of front end plate 11 by pins 27, an orbiting race 263 attached to the end surface of end plate 201, an orbiting ring 264 attached to the end surface of end plate 201 by pins 28, and a plurality of bearing elements such as balls 265. A plurality of holes or pockets are formed through rings 262 and 264 and a ball 265 is placed in facing, generally aligned pockets. The rotation of orbiting scroll 20 is prevented by the interaction between balls 265 and rings 262, 264; and axial thrust load from orbiting scroll 20 is supported by front end plate 11 through balls 265.

A grease seal mechanism 29 is placed between the outer peripheral portion of end plate 201 of orbiting scroll 20 and the inner end surface of front end plate 11. In this manner, grease which is enclosed within the space between front end plate 11 and end plate 201 is sealed off and is retained to lubricate bearings 16, 22 and rotation preventing/thrust bearing means 26. Bearing 23 which is located at the inner end of hollow interior 21 also has a grease seal mechanism.

Motor housing 13 is attached to the other end surface of front end plate 11 by a plurality of bolts 17. A motor 30 is supported in motor housing 13. Motor 30 includes a stator coil 301 connected to the inner surface of motor housing 13 and a rotor coil 302 assembled on drive shaft 15. The outer end of drive shaft 15 is rotatably supported by an end plate portion 131 of motor housing 13 through a bearing 31. Bearing 31 is carried in a recess in end plate portion 131. The apparatus is, therefore, driven by motor 30.

The center of mass $G_3$ of the orbital moving parts, including orbiting scroll member 20 and bearings 22, 23, is located on the axis of crank pin 152 and the centrifugal force $F_3$ which arises because of the orbiting motion of the orbital moving parts is applied at this point. Drive shaft 15 is provided with a pair of balance weights 31 and 32 to minimize the problems which would arise from the centrifugal force caused by the orbital motion of the orbital moving parts. Balance weight 31 is placed on drive shaft 15 near the end plate portion 131 of motor housing 13 and causes a centrifugal force $F_1$ in the same direction as the centrifugal force $F_3$ of orbital moving parts when drive shaft 15 is rotated. Balance weight 32 is placed on drive shaft 15 on an opposite radial side of drive shaft 15 as the balance weight 31 and on an opposite side in the axial direction relative to the balance weight 31. Balance weight 32 causes centrifugal force $F_2$ in opposite direction to the centrifugal force $F_1$ of balance weight 31 when drive shaft 15 is rotated.

Scroll type fluid displacement apparatus operates in the following manner. Motor 30 rotates drive shaft 30 which in turn orbits or revolves crank pin 152 at a radius Ror. Orbiting scroll member 20 is connected to crank pin 152, and therefore, is also driven in orbital motion of radius Ror. The rotation of orbiting scroll member 20 during the orbital motion is prevented by rotation preventing/thrust bearing device 26. As orbiting scroll member 20 orbits, line contacts between both spiral elements 121, 202 shifts either toward or away from the center of spiral elements along the surface of the spiral elements. The fluid pockets defined between the spiral elements 121, 202 move to the center from the external portion (or move to external portion from the center). The fluid introduced into inlet port 123 is thereby discharged from outlet port 122 after compression of the fluid pockets, or vice versa in an expansion mode.

In the present invention, the orbiting scroll has a tubular member extending from a radial center of the end plate of the orbiting scroll to the center of the spiral elements and is rotatably supported by a crank pin which is rotatably carried within the hollow interior of the tubular member. Therefore, the driving point of the orbital scroll can be near or in alignment with the center of mass of the orbital moving parts. With such an alignment, the orbital moving part can be driven stably without problems due to the moment generated.

Furthermore, in the present invention, the width of the spiral elements can be made larger, with the result that the inlet of volume of the apparatus can be increased.

This invention has been described in detail in connection with the preferred embodiment, but this embodiment is for example only and this invention is not restricted thereto. It will be easily understood by those skilled in the art that other variations and modifications can be easily made within the scope of this invention.

I claim:

1. A scroll type fluid displacement apparatus comprising:

a housing having a fluid inlet port and fluid outlet port;

a fixed scroll joined with said housing and having a first end plate from which a first wrap extends into an operative interior area of said housing;

an orbiting scroll having second end plate from which a second wrap extends, and a tubular member axially projecting from a generally central radial area of said second end plate into said operative interior area to at least adjacent the axial center of said first wrap, said first and second wraps interfitting at an angular and radial offset to make a plurality of line contacts to define at least one pair of fluid pockets;

rotation preventing means disposed in said housing for preventing the rotation of said orbiting scroll;

a driving mechanism including a drive shaft rotatably supported by said housing to drive said orbiting scroll in an orbital motion to thereby change the volume of said fluid pockets;

a crank pin axially projecting from an inner end of said drive shaft at a location radially offset from the center of said drive shaft, and said crank pin being rotatably carried in a hollow interior of said tubular member through a bearing assembly, at least a portion of said bearing assembly being carried in a recess in said hollow interior; and a snap ring attached to a distal end of said crank pin, and a spring washer placed between and in contact with said snap ring and said at least a portion of said bearing assembly.

2. The scroll type fluid displacement apparatus as claimed in claim 1 wherein said housing includes a scroll housing and a front end plate attached to said housing, and an end plate portion of said scroll housing forming said first end plate.

3. The scroll type fluid displacement apparatus as claimed in claim 2 wherein said first wrap is integral with said scroll housing.

4. The scroll type fluid displacement apparatus as claimed in claim 1 wherein said bearing assembly has a grease seal mechanism.

5. The scroll type fluid displacement apparatus as claimed in claim 4 wherein a grease seal mechanism is located between an end surface of said second end plate and an inner end surface of said front end plate.

6. The scroll type fluid displacement apparatus as claimed in claim 1 wherein two balance weights are attached to said drive shaft.

7. The scroll type fluid displacement apparatus as claimed in claim 1 wherein said housing includes a scroll housing, a front end plate, and a motor housing, said drive shaft extending within said motor housing and an outer end of said drive shaft being rotatably supported by said motor housing, and an electric drive motor supported in said motor housing, said electric drive motor being drivingly connected to said drive shaft.

8. The scroll type fluid displacement apparatus as claimed in claim 2 wherein one of said fluid ports is formed through the center of said end plate portion of said scroll housing, and the other of said fluid ports is formed on the outer peripheral surface of said scroll housing.

9. The scroll type fluid displacement apparatus as claimed in claim 1 wherein said tubular member extends axially at least to the center axial area of said second wrap and said bearing assembly includes a first bearing adjacent the distal end of said tubular member and a second bearing adjacent the location of said second end plate.

10. In a scroll type fluid displacement apparatus including a housing having an inlet port and an outlet port, a fixed scroll joined with said housing and having first end plate from which a first wrap extends into an operative interior area of said housing, an orbiting scroll having a second end plate from which a second wrap extends, said first and second wraps interfitting at an angular and radial offset to make a plurality of line contacts to define at least one pair of fluid pockets within said operative interior area, a driving mechanism connected to said orbiting scroll to drive said orbiting scroll in an orbital motion, and rotation preventing means for preventing the rotation of said orbiting scroll so that the volume of the fluid pockets changes during the orbital motion of said orbiting scroll, said driving mechanism including a drive shaft rotatably supported by said housing and a crank pin axially projecting from an inner end of said drive shaft, said orbiting scroll including a tubular member projecting axially from said second end plate and extending axially into said operative interior area a distance so that its distal end is located at least adjacent the axial center of said first wrap, said tubular member having a hollow interior, and said crank pin extending through and being rotatably carried in said hollow interior by a bearing assembly, said bearing assembly including a first bearing adjacent the distal end of said tubular member, said first bearing being carried in a recess in said hollow interior of said tubular member, a snap ring being attached to a distal end of said crank pin, and a spring washer being placed between and in contact with said snap ring and said first bearing.

11. The scroll type fluid displacement apparatus as claimed in claim 1 wherein said bearing assembly further includes a second bearing in said tubular member located adjacent the second end plate.

12. The scroll type fluid displacement apparatus as claimed in claim 1 wherein said tubular member is generally aligned with the radial center of said second end plate.

13. The scroll type fluid displacement apparatus as claimed in claim 10 wherein said bearing assembly has a grease seal mechanism.

14. The scroll type fluid displacement apparatus as claimed in claim 13 wherein a second grease seal mechanism is located between an end surface of said second end plate and an inner end surface of said housing.

15. The scroll type fluid displacement apparatus as claimed in claim 10 wherein two balance weights are attached to said drive shaft.

16. The scroll type fluid displacement apparatus as claimed in claim 10 wherein said driving mechanism includes an electric motor connected to said drive shaft.

17. The scroll type fluid displacement apparatus as claimed in claim 16 wherein said housing includes a motor housing which encloses said electric motor, the outer end portion of said drive shaft being rotatably supported by said motor housing.

* * * * *